US012510252B2

(12) United States Patent
Shinde et al.

(10) Patent No.: US 12,510,252 B2
(45) Date of Patent: Dec. 30, 2025

(54) USER INTERFACE MOUNTING BRACKET

(71) Applicant: WHIRLPOOL CORPORATION, Benton Harbor, MI (US)

(72) Inventors: Pravin A. Shinde, Maharashtra (IN); Vasanti D. Kahane, Maharashtra (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 72 days.

(21) Appl. No.: 18/643,438

(22) Filed: Apr. 23, 2024

(65) Prior Publication Data

US 2025/0327582 A1 Oct. 23, 2025

(51) Int. Cl.
*F24C 15/08* (2006.01)

(52) U.S. Cl.
CPC ..... *F24C 15/08* (2013.01)

(58) Field of Classification Search
CPC .. F24C 15/08; F24C 3/12; F24C 3/122; F24C 3/124; F24C 3/126; F24C 5/16; F24C 7/08; F24C 7/082; F24C 7/086; F24C 15/2021; F24C 7/083; F16M 13/02
See application file for complete search history.

(56) References Cited

U.S. PATENT DOCUMENTS 5,473,807 A * 12/1995 Tupa ..... A47L 15/42 29/525.01
8,420,988 B2 4/2013 Geiger et al.
10,801,732 B2 10/2020 Kozinski et al.

FOREIGN PATENT DOCUMENTS

KR 100869079 B1 11/2008
WO 2020038769 A1 2/2020

* cited by examiner

*Primary Examiner* — Jason L Vaughan
*Assistant Examiner* — Amanda Kreiling
(74) *Attorney, Agent, or Firm* — BROOKS KUSHMAN P.C.

(57) ABSTRACT

A user-interface (UI) mounting bracket for one-way installation into an appliance includes a generally planar surface defining a mounting opening for holding a UI assembly to a console subsystem; a first side flange extending upwards along one longitudinal side of the UI mounting bracket; and a second side flange extending downwards along the opposite longitudinal side of the UI mounting bracket, wherein the opposite directions of the first and second side flanges enforces a one-way orientation of the UI mounting bracket such that interference between the side flanges and the UI assembly prevents the UI mounting bracket from being installed upside down.

20 Claims, 8 Drawing Sheets

USER INTERFACE MOUNTING BRACKET

TECHNICAL FIELD

Aspects of the disclosure generally relates to a user-interface (UI) mounting bracket for a front console of a range or range top cooking appliance.

BACKGROUND

A cooktop refers to a drop-in cooking appliance that is placed in a cut-out in a countertop with controls on the cooktop surface. A range top refers to a cooking appliance that is like a cooktop, but is installed between countertop sections as a slide-in unit with controls on its front face. A range refers to a cooking appliance that is a combination between a stove top and an oven in one unit. A range may typically have controls like a range top, on its front face. A range or a range top design may include a front console assembly that houses various UI controls, such as knobs, screens, and switches.

SUMMARY

In one or more illustrative examples, a user-interface (UI) mounting bracket for one-way installation into an appliance includes a generally planar surface defining a mounting opening for holding a UI assembly to a console subsystem; a first side flange extending upwards along one longitudinal side of the UI mounting bracket; and a second side flange extending downwards along the opposite longitudinal side of the UI mounting bracket, wherein the opposite directions of the first and second side flanges enforces a one-way orientation of the UI mounting bracket such that interference between the side flanges and the UI assembly prevents the UI mounting bracket from being installed upside down.

In one or more illustrative examples, the mounting opening is sized to allow passage of a back housing of the UI assembly but to prevent passage of a flange of the UI assembly to facilitate securing the UI assembly to the console subsystem.

In one or more illustrative examples, the first and second side flanges provide pressure uniformity between the UI mounting bracket and the console subsystem by transferring load along the first and second side flanges.

In one or more illustrative examples, the planar surface defines a series of asymmetrical mounting holes on either side of the mounting opening and adapted to receive fasteners serving to hold the UI mounting bracket onto the console subsystem.

In one or more illustrative examples, the mounting holes are asymmetrically arranged at vertices of a trapezoid to enforce a one-way left-right orientation of the UI mounting bracket.

In one or more illustrative examples, the planar surface defines an upwardly-directed positioning tab arranged next to a lateral side of the mounting opening, such that the back housing of the UI assembly is adjacent the positioning tab when assembled in the correct orientation.

In one or more illustrative examples, an assembly for one-way installation of a UI mounting bracket into an appliance, includes a UI assembly defining an enclosure for retaining UI controls, the UI assembly comprising a front plate defining a generally flat top surface and back housing defining side and rear walls forming a remainder of an enclosure, the front plate exposing the controls, the back housing further defining a flange extending laterally around the side walls of the enclosure; and a UI mounting bracket comprising a generally planar surface defining a mounting opening for holding a UI assembly to a console subsystem, a first side flange extending upwards along one longitudinal side of the UI mounting bracket, and a second side flange extending downwards along the opposite longitudinal side of the UI mounting bracket, wherein the opposite directions of the first and second side flanges enforces a one-way orientation of the UI mounting bracket such that interference between the side flanges and the UI assembly prevents the UI mounting bracket from being installed upside down.

In one or more illustrative examples, the mounting opening is sized to allow passage of the back housing of a UI assembly but not the flange of the UI assembly for securing the UI assembly to a console subsystem.

In one or more illustrative examples, the first and second side flanges provide pressure uniformity between the UI mounting bracket and the console subsystem by transferring load along the first and second side flanges.

In one or more illustrative examples, the planar surface defines a series of asymmetrical mounting holes on either side of the mounting opening, the mounting holes being adapted to receive fasteners serving to hold the UI mounting bracket onto the console subsystem.

In one or more illustrative examples, the mounting holes are asymmetrically arranged at vertices of a trapezoid to enforce a one-way left-right orientation of the UI mounting bracket.

In one or more illustrative examples, the console subsystem defines one or more raised stops to maintain the UI mounting bracket an offset distance from an underside of a horizontal upper surface of the console subsystem to allow for the flange to sit between the UI mounting bracket and the underside of the horizontal upper surface.

In one or more illustrative examples, the stops define mounting apertures for receiving fasteners through the mounting holes to hold the UI mounting bracket onto the console subsystem.

In one or more illustrative examples, the planar surface defines an upwardly-directed positioning tab arranged next to a lateral side of the mounting opening, such that the back housing of the UI assembly is adjacent the positioning tab when assembled in the correct orientation.

In one or more illustrative examples, a method of installation of a UI mounting bracket into an appliance includes installing a UI assembly into a console subsystem of the appliance, the console subsystem defining a space to retain and protect the components of UI assembly, the UI assembly defining an enclosure for retaining UI controls; installing a UI mounting bracket around the UI assembly, the UI mounting bracket comprising a generally planar surface defining a mounting opening sized to allow passage of a back housing of a UI assembly but not a flange of the UI assembly; and securing the UI assembly to the console subsystem by passing fasteners through a series of asymmetrical mounting holes on either side of the mounting opening into corresponding mounting apertures of the console subsystem.

In one or more illustrative examples, the method includes comprising transferring load along the first and second side flanges to provide pressure uniformity between the UI mounting bracket and the console subsystem.

In one or more illustrative examples, securing the UI assembly to the console subsystem includes tightening the UI mounting bracket onto one or more raised stops of the console subsystem to be maintained an offset distance from an underside of a horizontal upper surface of the console subsystem, allowing for the flange to sit between the UI mounting bracket and the underside of the horizontal upper surface.

In one or more illustrative examples, the method includes arranging an upwardly-directed positioning tab of the planar surface defines an upwardly-directed next to a lateral side of the mounting opening, such that the back housing of the UI assembly is adjacent the positioning tab when assembled in the correct orientation.

In one or more illustrative examples, the mounting holes are asymmetrically arranged at vertices of a trapezoid to enforce a one-way left-right orientation of the UI mounting bracket.

In one or more illustrative examples, the method includes removing the fasteners to free the UI mounting bracket, uninstalling the UI mounting bracket, and uninstalling the UI assembly.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A user-interface (UI) mounting bracket may be used to retain human-machine interface (HMI) components of a cooking appliance. The UI mounting bracket may define various asymmetrical features to enforce a one-way poka-yoke assembly of the UI mounting bracket to the appliance. These asymmetrical features may include asymmetrical mounting holes and an asymmetrical side rib design.

The asymmetrical side rib design may include a first side flange that extends upwards along one longitudinal side of the bracket, and a second side flange that extends downwards along the opposite longitudinal side of the bracket. Interference between the side flanges and other components of the cooking appliance may prevent the UI mounting bracket from being installed upside down. In addition to enforcing a single assembly direction, this side rib design may provide pressure uniformity between the UI mounting bracket and a housing of the cooking appliance by uniformly transferring at least a portion of any load along the side ribs. The UI mounting bracket may include positioning tabs to further prevent installation in an incorrect orientation. The UI mounting bracket may also be tightened against a foam gasket, without requiring use of adhesive.

Figure 1:
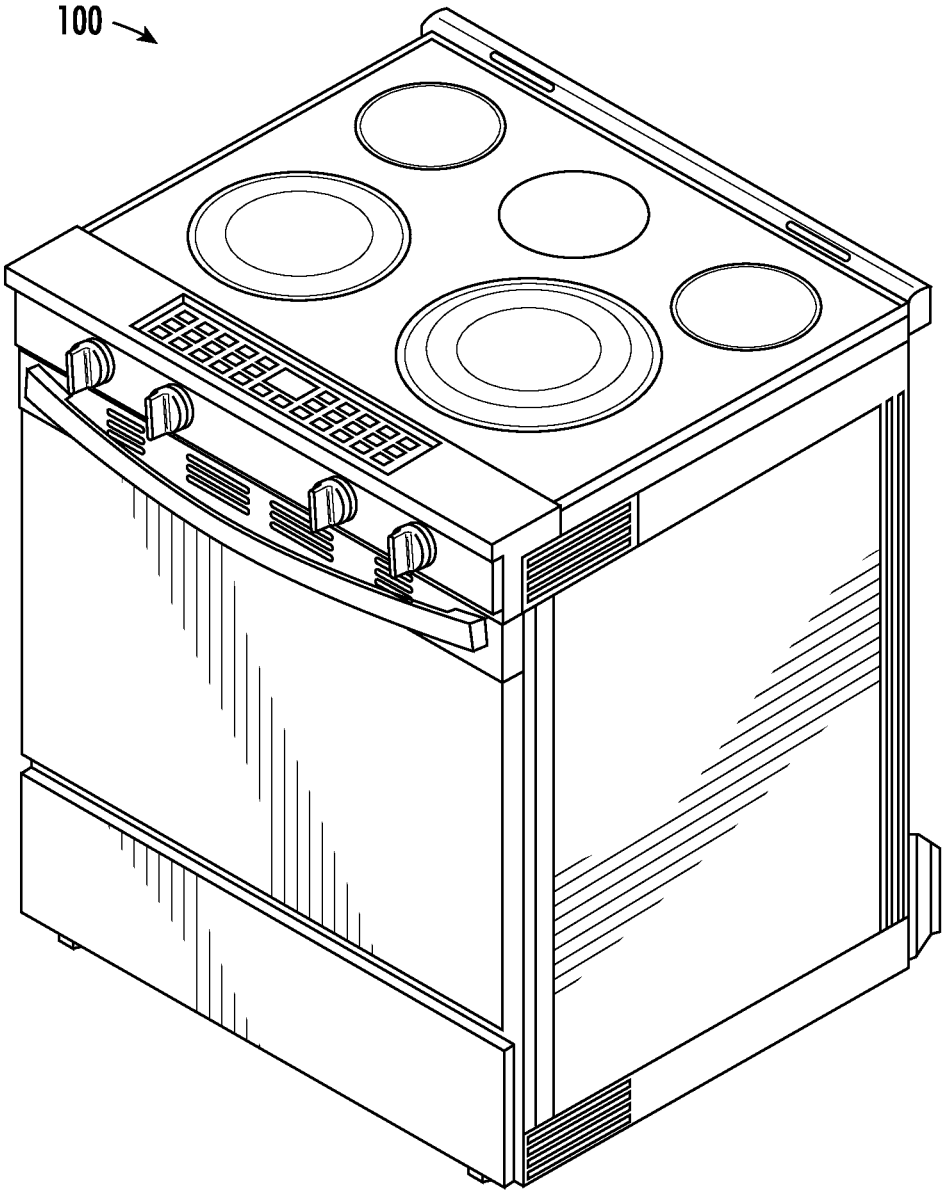
FIG. 1 illustrates a perspective view of a cooking appliance, in accordance with an embodiment of the disclosure.

FIG. 1 illustrates a perspective view of a cooking appliance 100. As shown, the cooking appliance 100 is a range combination of a stove top and an oven in one unit. Ranges may come in a variety of styles, sizes and fuel types, allowing the range to complement different cooking routines and kitchen aesthetics. For example, the range may include gas burners, induction hobs, and/or electric coil heating elements. The oven may offer the same or a different fuel type than the cooktop, and may include electric, gas, and/or microwave heating elements. While a single cavity oven is illustrated, more than one cavity may be included. Further, more or fewer burners may be contemplated.

Figure 2:
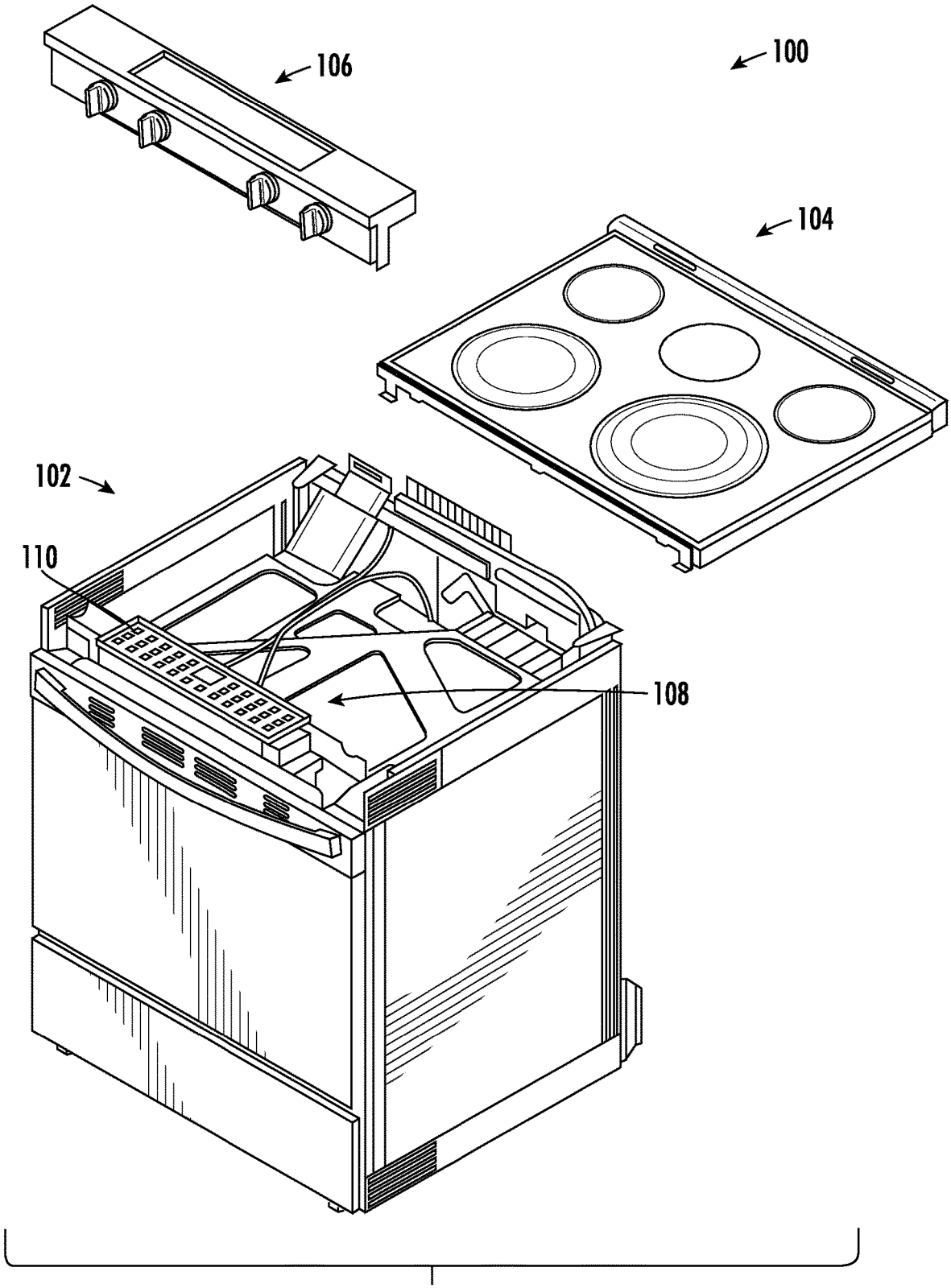
FIG. 2 illustrates a perspective exploded view of certain subsystems of the cooking appliance of FIG. 1.

FIG. 2 illustrates an example perspective view of certain subsystems of the cooking appliance 100. As shown by way of example, the cooking appliance 100 includes a chassis subsystem 102, a surface subsystem 104, a console subsystem 106, and a UI assembly 108. These components may be assembled to form the complete cooking appliance 100 as shown in FIG. 1.

The chassis subsystem 102 defines a generally box-like cabinet having a front access opening which is closed by a pivotally mounted door. The surface subsystem 104 is installable to the top rear of the chassis subsystem 102 and defines a cooktop having a series of burners or heating elements. The console subsystem 106 may be installed to the top front of the chassis subsystem 102, in front of the surface subsystem 104. The console subsystem 106 defines a space to retain and protect the components of UI assembly 108. For instance, the console subsystem 106 may provide for mounting of the UI assembly 108 at the center front of the top surface of the appliance 100.

Figure 3A:
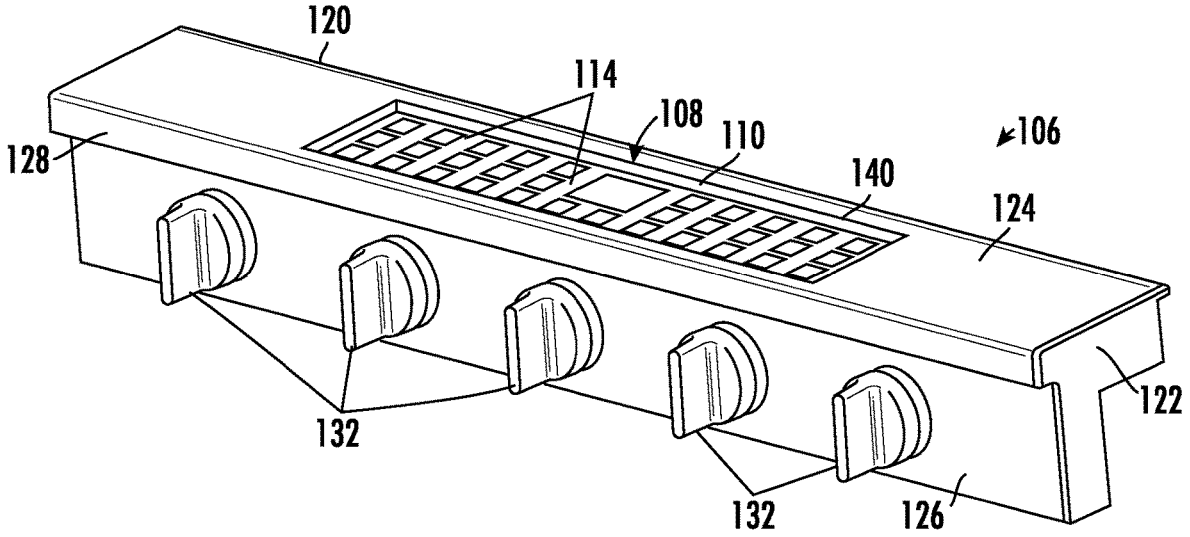
FIG. 3A illustrates a front perspective view of the console subsystem with the UI assembly installed.
Figure 3B:
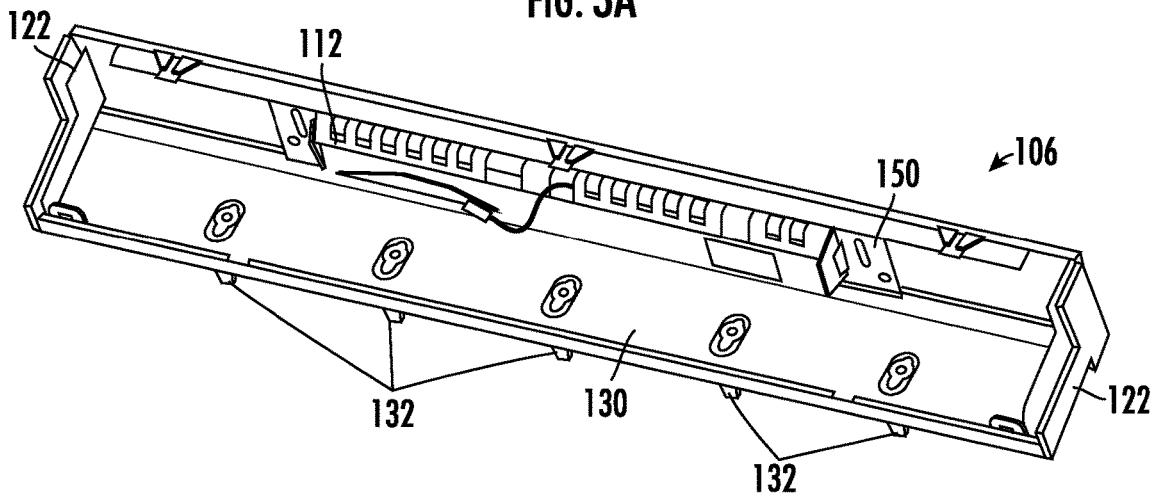
FIG. 3B illustrates a rear perspective view of the console subsystem 04 with the UI assembly installed.
Figure 3C:
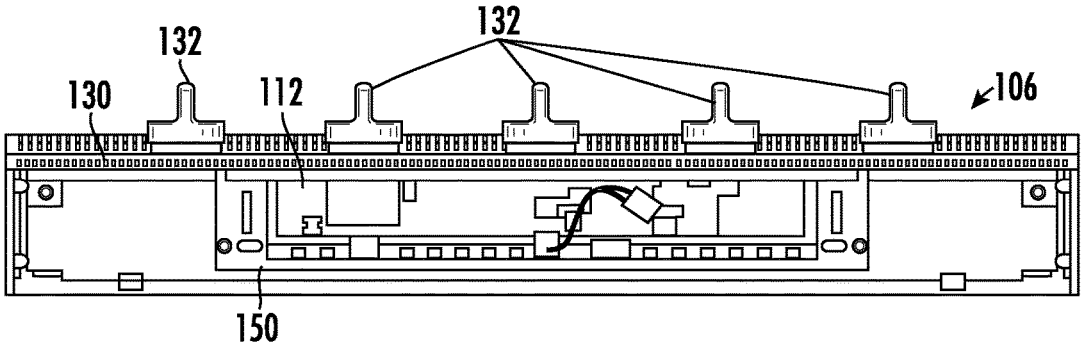
FIG. 3C illustrates a bottom view of the console subsystem with the UI assembly installed.

FIG. 3A illustrates a front perspective view of the console subsystem 104 with the UI assembly 108 installed. FIG. 3B illustrates a rear perspective view of the console subsystem 104 with the UI assembly 108 installed. FIG. 3C illustrates a bottom view of the console subsystem 104 with the UI assembly 108 installed.

The UI assembly 108 may retain various buttons, screens, and/or other components of the UI of the cooking appliance 100 in place for access by the user. To do so, the UI assembly 108 may comprise an enclosure having a generally rectangular prism shape defined by a front plate 110 and a back housing 112.

The front plate 110 may define the generally flat top surface of the UI assembly 108 which exposes the various controls 114 for interaction with the user. These controls 114 may include buttons for selection of appliance 100 functions as well as display screens for the indication of temperature, timers, or other status information.

Figure 4:
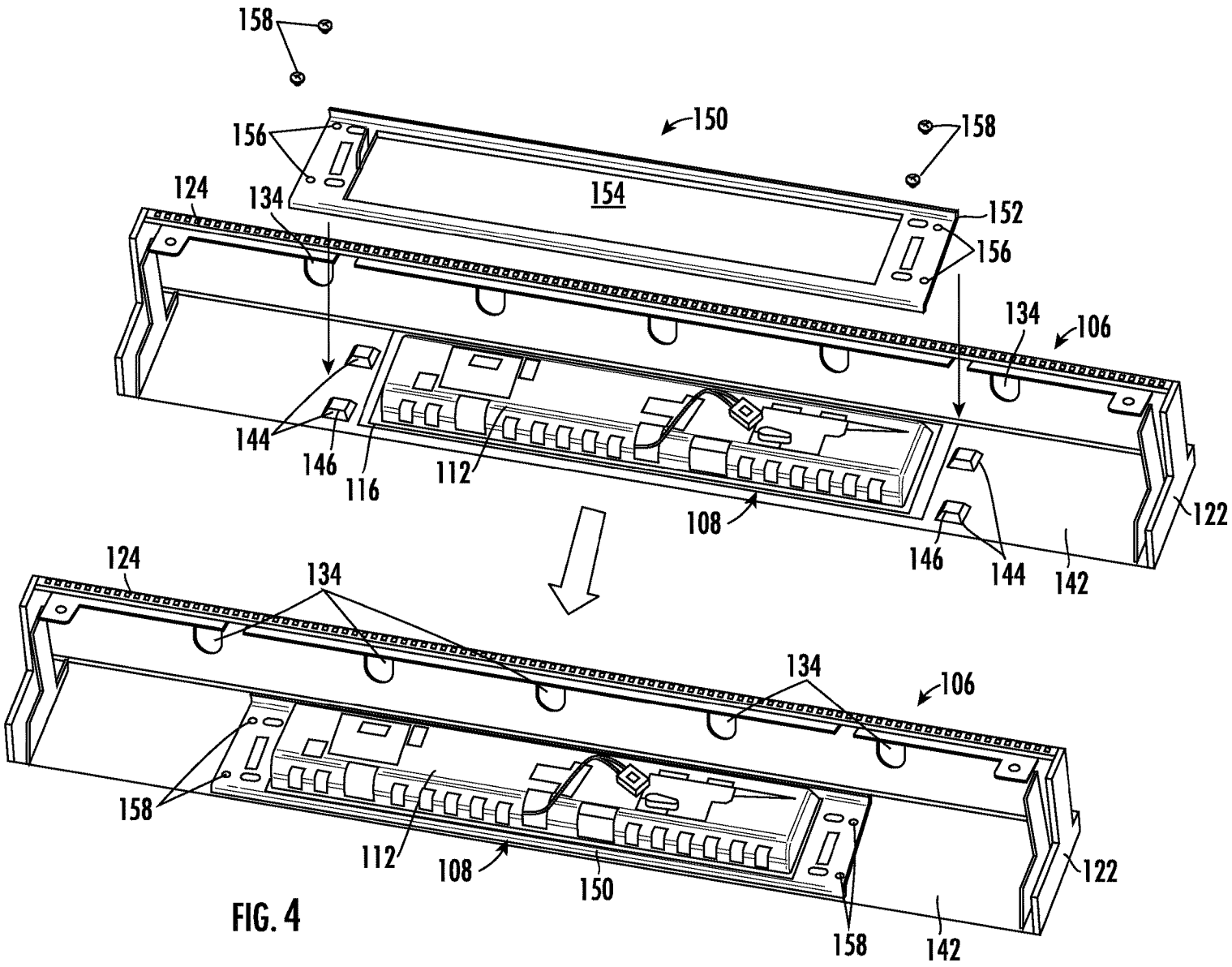
FIG. 4 illustrates an exploded bottom view of the console subsystem before and after installation of the UI mounting bracket.
Figure 6A:
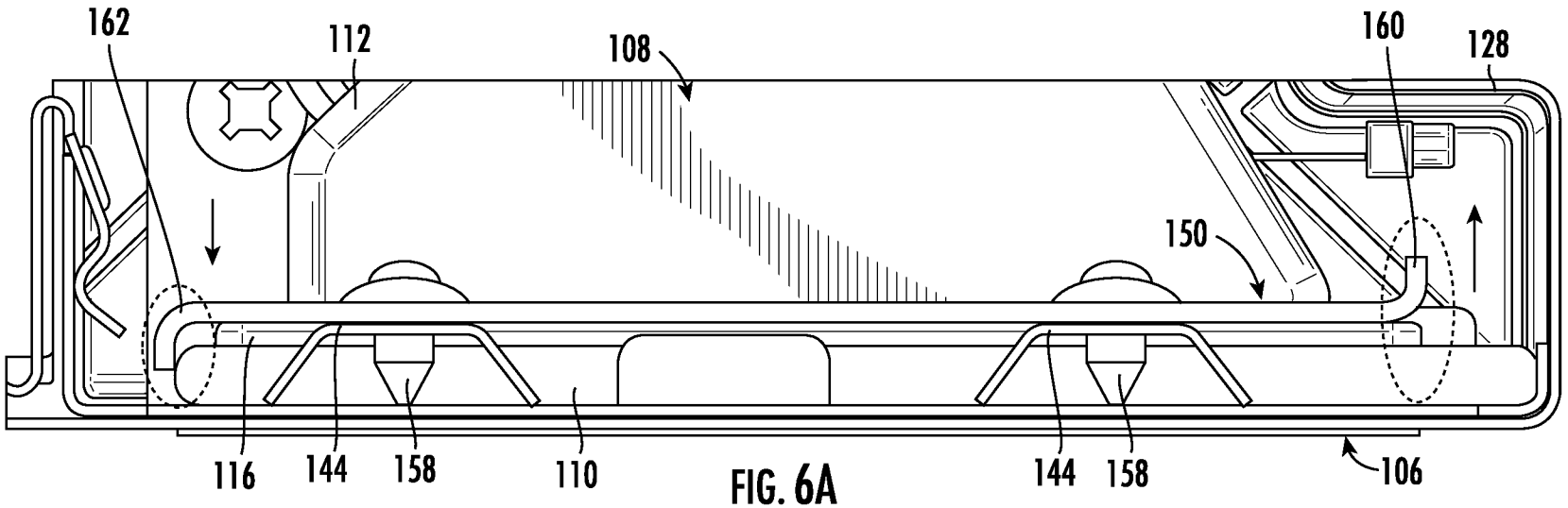
FIG. 6A illustrates a side view of the UI mounting bracket in a correct orientation for installation to the console subsystem.
Figure 6B:
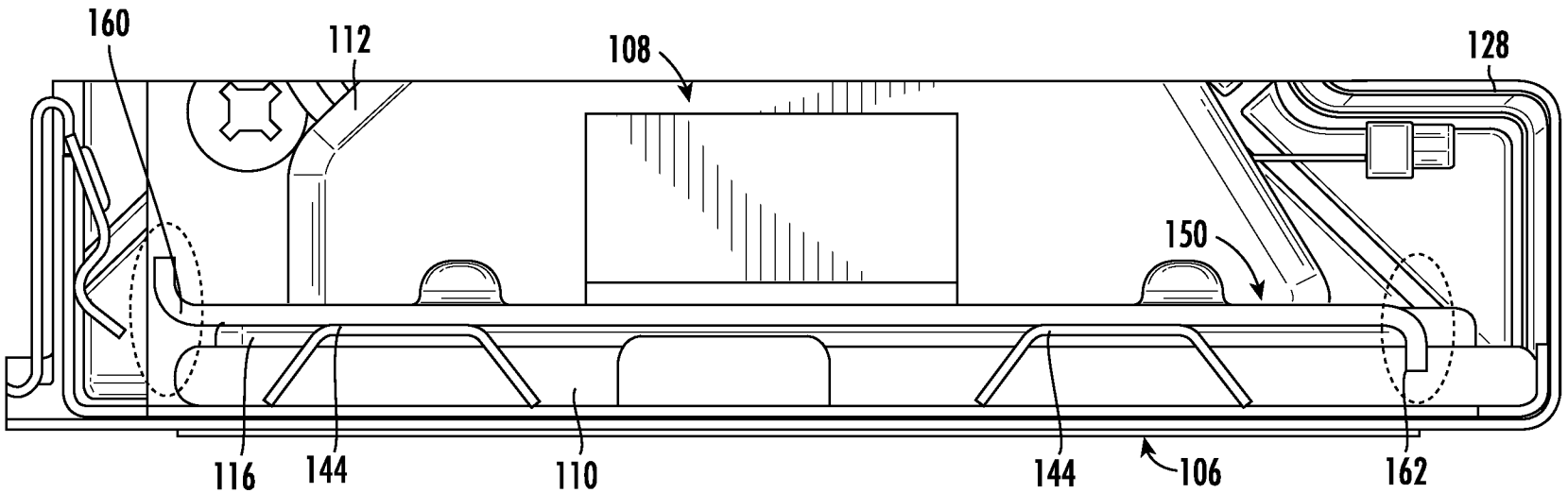
FIG. 6B illustrates a side view of the UI mounting bracket in an incorrect orientation for installation to the console subsystem.

The back housing 112 may define the remainder of the enclosure, including the side and rear walls that enclose the touch controls 114 and electronics of the UI assembly 108. The back housing 112 may also define a flange 116 extending around the enclosure body to facilitate attachment of the UI assembly 108 (as best seen in FIGS. 4 and 6A-6B).

The console subsystem 104 includes a shell member 120 and a pair of opposed, vertically-oriented side members 122. The shell member 120 defines a horizontal upper surface 124 and a vertical front surface 126. The shell member 120 and side members 122 cooperate to define the top and lateral sides of the console subsystem 104. As shown, the upper surface 124 extends forwards beyond the front of the front surface 126 providing an overhang 128. The overhang 128 may serve to match the contour of a countertop surrounding the cooking appliance 100 when installed between kitchen cabinets.

The console subsystem 104 also may include a knob assembly 130 mounted inside the shell member 120 behind the front surface 126. The knob assembly 130 may include a plurality of knobs 132 for use in controlling operation of the appliance 130. As shown, the knobs 132 allow for rotational control of heat level or other appliance 100 functions. The front surface 126 may define a series of knob apertures 134 (best seen in FIG. 4). The knob apertures 134 may provide for passage of shafts of the knobs 132 of the knob assembly 130 retained inside the console subsystem 104.

The horizontal upper surface 124 of console subsystem 104 may define a generally rectangular opening 140. As explained in detail herein, the UI assembly 108 may be attached to the underside 142 of the horizontal upper surface 124, such that the front plate 110 of the UI assembly 108 is visible and accessible through the rectangular opening 140.

FIG. 4 illustrates an exploded bottom perspective view of the console subsystem 104 before and after installation of the UI mounting bracket 150. The UI mounting bracket 150 comprises a generally planar main surface 152 that defines a generally rectangular mounting opening 154. The rectangular mounting opening 154 may have dimensions (e.g., length and width) to allow passage of the side and rear walls of the back housing 112 but not the flange 114. In an example, the UI mounting bracket 150 may be comprised of a metal material such as aluminum or steel and may be formed via one or more stamping and/or punching operations.

As shown in the top portion of FIG. 4, the UI assembly 108 is placed into the generally rectangular opening 140 of the horizontal upper surface 124 of console subsystem 104. The front plate 110 (not shown in FIG. 4) of the UI assembly 108 may pass through the rectangular opening 140 until the flange 114 stops against the underside 142 of the upper surface 124. The flange 116 of the UI assembly 108 may accordingly lie flat against the underside 142 of the upper surface 124 of the console subsystem 106.

The underside 142 of the horizontal upper surface 124 may define one or more raised stops 144, such as ridges, embossments, fins, or bumps. The stops 144 may maintain the generally planar main surface 152 of the UI mounting bracket 150 an offset distance from the underside 142 of the horizontal upper surface 124. This spaced-away placement may allow for the flange 114 to sit between the UI mounting bracket 150 and the underside 142 of the horizontal upper surface 124.

The main surface 152 of the UI mounting bracket 150 may further define series of mounting holes 156 provided on either side of the mounting opening 154. The mounting holes 156 may be through holes adapted to receive screws or other fasteners 158. Additionally, the stops 144 may define apertures 146 configured for receiving the fasteners 158 passed through the mounting holes 156. In one example, the fasteners 158 are screws and the apertures 146 are threaded to allow for the fasteners 158 to be tightened down, securing the UI mounting bracket 150 over the flange 114 to keep the UI assembly 108 in place. Thus, the mounting apertures 156 are adapted to receive fasteners 158 serving to hold the UI mounting bracket 150 onto the console subsystem 104. Other fasteners may be used such as screws with flanges, snap-fit screws, etc.

The UI mounting bracket 150 may serve to reduce any gap between the front plate 110 of the UI assembly 108 and the horizontal upper surface 124 of the console subsystem 104. In some examples, the UI mounting bracket 150 may be tightened against a foam gasket (not shown), without requiring use of adhesive. The UI mounting bracket 150 may also serve to provide pressure uniformity between with the console subsystem 104 due to tightening torque of the fasteners 158.

The UI mounting bracket 150 may define various asymmetrical features to enforce a one-way poka-yoke assembly of the UI mounting bracket 150 to the console subsystem 104. These asymmetrical features may include asymmetrical mounting holes 156. For instance, the mounting holes 156 may be placed at the vertices of a trapezoid. The apertures 146 of the stops 144 may thus be placed in corresponding locations to receive the fasteners 158 through the mounting holes 156. In such a design, the mounting holes 156 will only align with the apertures 146 in a single orientation. Thus, the asymmetrical mounting holes 156 may enforce a one-way left-right orientation of the UI mounting bracket 150.

Figure 5A:
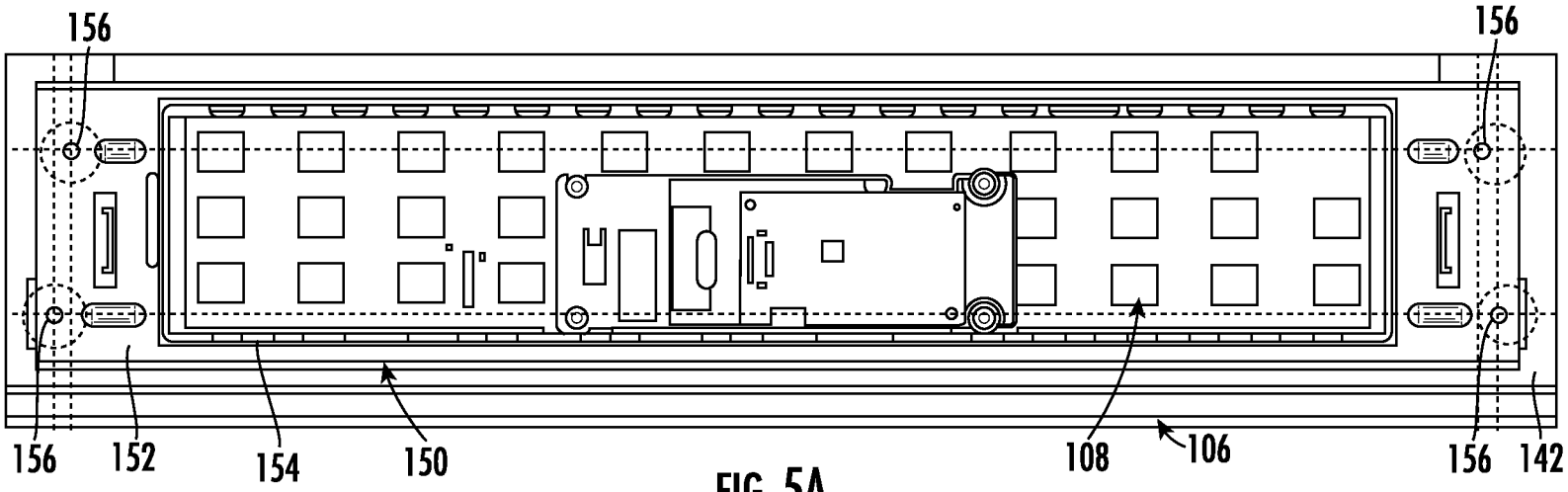
FIG. 5A illustrates a plan view of the UI mounting bracket in a correct orientation for installation to the console subsystem.
Figure 5B:
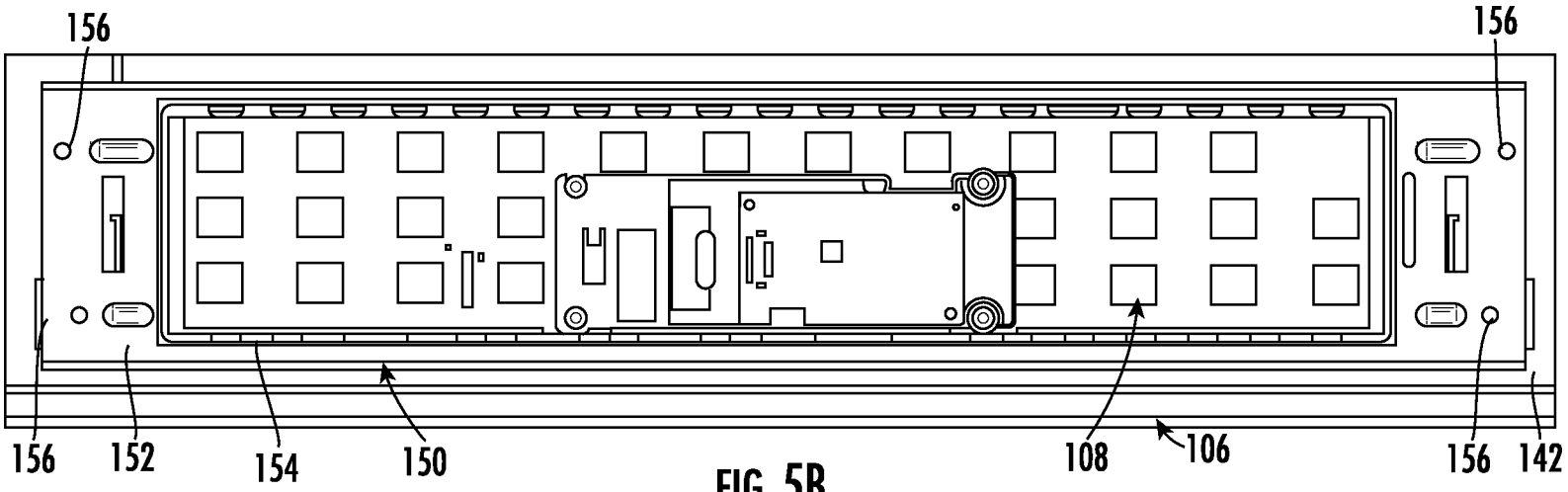
FIG. 5B illustrates a plan view of the UI mounting bracket in an incorrect orientation for installation to the console subsystem.

FIG. 5A illustrates an example plan view of the UI mounting bracket 150 in the correct orientation for installation to the console subsystem 106. FIG. 5B illustrates an example plan view of the UI mounting bracket 150 in the incorrect orientation for installation to the console subsystem 106. As shown in FIG. 5A, the mounting holes 156 align with the apertures 146 of the stops 144 below, allowing the fasteners 158 to be installed. However, as shown in FIG. 5B, the mounting holes 156 do not align with the apertures 146, and therefore the fasteners 158 cannot be installed.

The UI mounting bracket 150 may also define asymmetrical flanges to further enforce the one-way assembly of the UI mounting bracket 150 to the console subsystem 104. For instance, the UI mounting bracket 150 may define a first side flange 160 extending upwards along one longitudinal side of the UI mounting bracket 150, and a second side flange 162 extending downwards along the opposite longitudinal side of the UI mounting bracket 150. The first and second side flanges 160, 162 serve to add stiffness to the structure of the UI mounting bracket 150. The first and second side flanges 160, 162 may also provide pressure uniformity between the UI mounting bracket and the console subsystem 106 by uniformly transferring load along the first and second side flanges 160, 162, even though the first and second side flanges 160, 162 have opposite orientations. Thus, the first and second side flanges 160, 162 may enforce a one-way top-bottom orientation of the UI mounting bracket 150.

FIG. 6A illustrates an example side view of the UI mounting bracket 150 in a correct orientation for installation to the console subsystem 106. FIG. 6B illustrates an example side view of the UI mounting bracket 150 in an incorrect orientation for installation to the console subsystem 106.

As shown in FIG. 6A, the second side flange 162 extends downwards, clearing the front plate 110 of the UI assembly 108. In contrast, however, as shown in FIG. 6B, with the second side flange 162 on the opposite longitudinal side, the second side flange 162 interferes with the front plate 110 of the UI assembly 108, preventing installation of the UI mounting bracket 150. It can also be seen that the mounting holes 156 align with the apertures 146 of the stops 144 in FIG. 6A, allowing the fasteners 158 to be installed. However, as shown in FIG. 6B, the mounting holes 156 do not align with the apertures 146, and therefore the fasteners 158 cannot be installed.

Figure 7A:
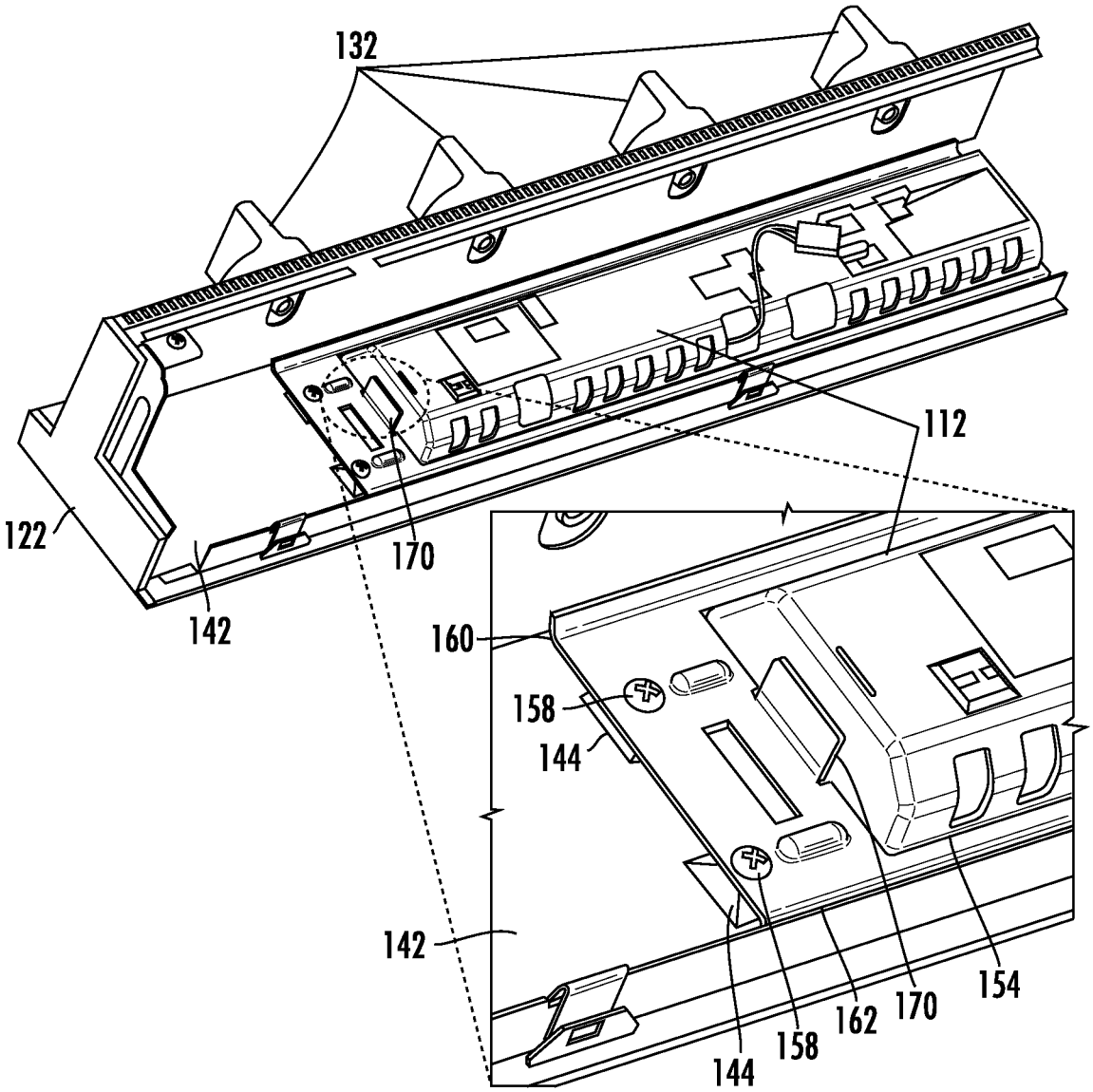
FIG. 7A illustrates a rear perspective view of the positioning tab of the UI mounting bracket in a correct orientation for installation to the console subsystem.

FIG. 7A illustrates an example perspective view of the positioning tab 170 of the UI mounting bracket 150 in a correct orientation for installation to the console subsystem 106. FIG. 6B illustrates an example perspective view of the UI mounting bracket 150 with the positioning tab 170 in an incorrect orientation for installation to the console subsystem 106.

The positioning tab 170 may be arranged to further prevent installation of the UI mounting bracket 150 in the incorrect orientation. The positioning tab 170 may be upwardly-directed and arranged next to a lateral side of the mounting opening 154 such that the back housing 112 of the UI assembly 108 is adjacent the positioning tab 170 when properly assembled in the correct orientation. While one position tab 170 is illustrated, more than one tab 170 may be contemplated.

Figure 7B:
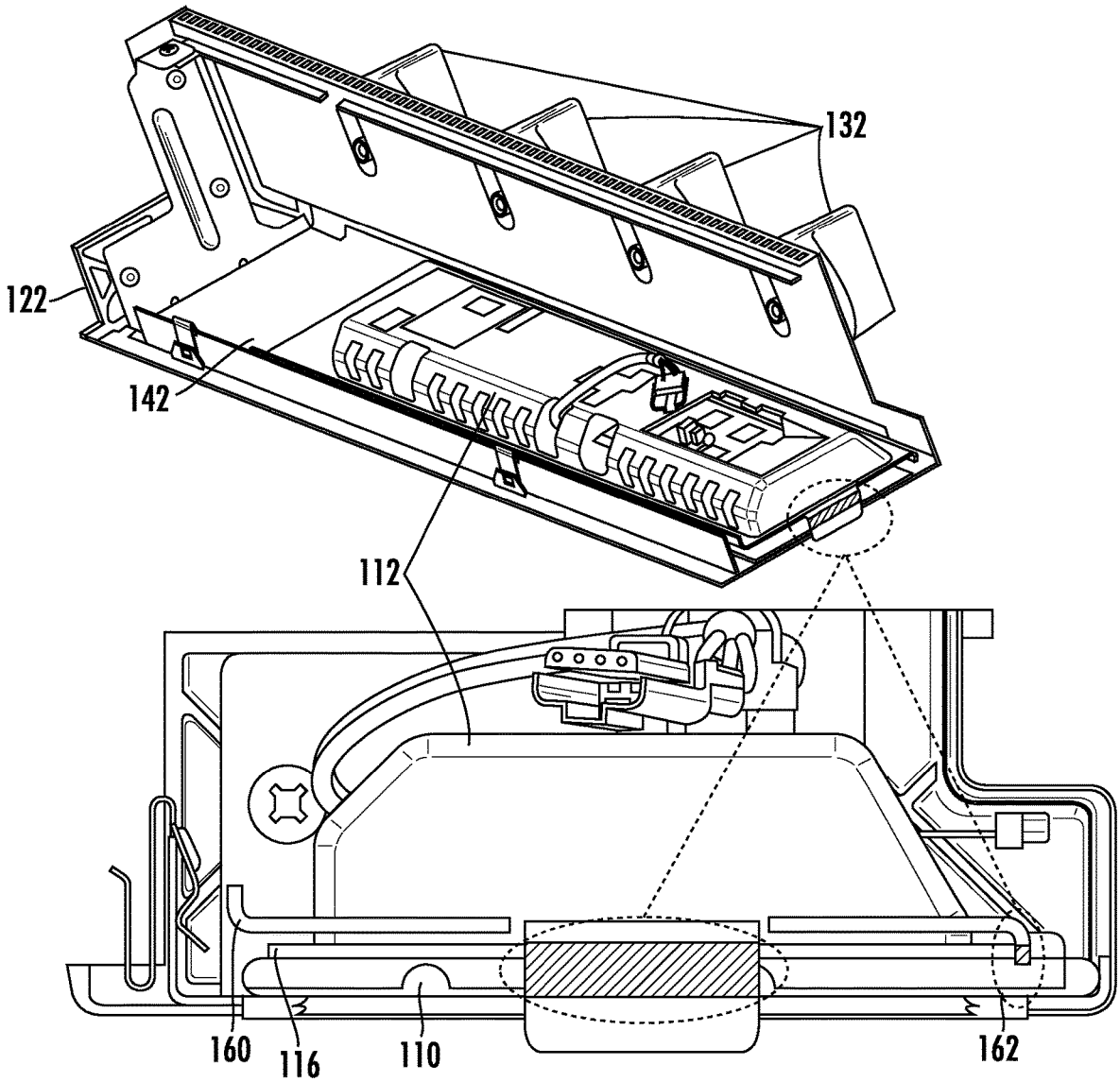
FIG. 7B illustrates a rear perspective view of the UI mounting bracket with the positioning tab in an incorrect orientation for installation to the console subsystem.

As shown in FIG. 7B, the UI mounting bracket 150 is attempted to be installed upside down. In this case, the positioning tab 170 is downwardly-directed, which causes the positioning tab 170 to interfere with the components of the UI assembly 108, preventing upside down installation of the UI mounting bracket 150. Thus, the positioning tab 170 may enforce a one-way up-down orientation of the UI mounting bracket 150.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A user-interface (UI) mounting bracket for one-way installation into an appliance, comprising:

a generally planar surface defining a mounting opening for holding a UI assembly to a console subsystem;

a first side flange extending upwards along one longitudinal side of the UI mounting bracket; and a second side flange extending downwards along the opposite longitudinal side of the UI mounting bracket, wherein the opposite directions of the first and second side flanges enforces a one-way orientation of the UI mounting bracket such that interference between the side flanges and the UI assembly prevents the UI mounting bracket from being installed upside down.

2. The UI mounting bracket of claim 1, wherein the mounting opening is sized to allow passage of a back housing of the UI assembly but to prevent passage of a flange of the UI assembly to facilitate securing the UI assembly to the console subsystem.

3. The UI mounting bracket of claim 1, wherein the first and second side flanges provide pressure uniformity between the UI mounting bracket and the console subsystem by transferring load along the first and second side flanges.

4. The UI mounting bracket of claim 1, wherein the planar surface defines a series of asymmetrical mounting holes on either side of the mounting opening and adapted to receive fasteners serving to hold the UI mounting bracket onto the console subsystem.

5. The UI mounting bracket of claim 4, wherein the mounting holes are asymmetrically arranged at vertices of a trapezoid to enforce a one-way left-right orientation of the UI mounting bracket.

6. The UI mounting bracket of claim 1, wherein the planar surface defines an upwardly-directed positioning tab arranged next to a lateral side of the mounting opening, such that the back housing of the UI assembly is adjacent the positioning tab when assembled in the correct orientation.

7. An assembly for one-way installation of a UI mounting bracket into an appliance, comprising:

a UI assembly defining an enclosure for retaining UI controls, the UI assembly comprising a front plate defining a generally flat top surface and back housing defining side and rear walls forming a remainder of an enclosure, the front plate exposing the controls, the back housing further defining a flange extending laterally around the side walls of the enclosure; and a UI mounting bracket comprising a generally planar surface defining a mounting opening for holding a UI assembly to a console subsystem, a first side flange extending upwards along one longitudinal side of the UI mounting bracket, and a second side flange extending downwards along the opposite longitudinal side of the UI mounting bracket, wherein the opposite directions of the first and second side flanges enforces a one-way orientation of the UI mounting bracket such that interference between the side flanges and the UI assembly prevents the UI mounting bracket from being installed upside down.

8. The assembly of claim 1, wherein the mounting opening is sized to allow passage of the back housing of a UI assembly but not the flange of the UI assembly for securing the UI assembly to a console subsystem.

9. The assembly of claim 8, wherein the first and second side flanges provide pressure uniformity between the UI mounting bracket and the console subsystem by transferring load along the first and second side flanges.

10. The assembly of claim 7, wherein the planar surface defines a series of asymmetrical mounting holes on either side of the mounting opening, the mounting holes being adapted to receive fasteners serving to hold the UI mounting bracket onto the console subsystem.

11. The assembly of claim 10, wherein the mounting holes are asymmetrically arranged at vertices of a trapezoid to enforce a one-way left-right orientation of the UI mounting bracket.

12. The assembly of claim 10, wherein the console subsystem defines one or more raised stops to maintain the UI mounting bracket an offset distance from an underside of a horizontal upper surface of the console subsystem to allow for the flange to sit between the UI mounting bracket and the underside of the horizontal upper surface.

13. The assembly of claim 12, wherein the stops define mounting apertures for receiving fasteners through the mounting holes to hold the UI mounting bracket onto the console subsystem.

14. The UI mounting bracket of claim 7, wherein the planar surface defines an upwardly-directed positioning tab arranged next to a lateral side of the mounting opening, such that the back housing of the UI assembly is adjacent the positioning tab when assembled in the correct orientation.

15. A method of installation of a UI mounting bracket into an appliance, comprising:

installing a UI assembly into a console subsystem of the appliance, the console subsystem defining a space to retain and protect the components of UI assembly, the UI assembly defining an enclosure for retaining UI controls;

installing a UI mounting bracket around the UI assembly, the UI mounting bracket comprising a generally planar surface defining a mounting opening sized to allow passage of a back housing of a UI assembly but not a flange of the UI assembly; and securing the UI assembly to the console subsystem by passing fasteners through a series of asymmetrical mounting holes on either side of the mounting opening into corresponding mounting apertures of the console subsystem.

16. The method of claim 15, further comprising transferring load along the first and second side flanges to provide pressure uniformity between the UI mounting bracket and the console subsystem.

17. The method of claim 15, wherein securing the UI assembly to the console subsystem includes tightening the UI mounting bracket onto one or more raised stops of the console subsystem to be maintained an offset distance from an underside of a horizontal upper surface of the console subsystem, allowing for the flange to sit between the UI mounting bracket and the underside of the horizontal upper surface.

18. The method of claim 15, further comprising arranging an upwardly-directed positioning tab of the planar surface defines an upwardly-directed next to a lateral side of the mounting opening, such that the back housing of the UI assembly is adjacent the positioning tab when assembled in the correct orientation.

19. The method of claim 15, wherein the mounting holes are asymmetrically arranged at vertices of a trapezoid to enforce a one-way left-right orientation of the UI mounting bracket.

20. The method of claim 15, further comprising removing the fasteners to free the UI mounting bracket, uninstalling the UI mounting bracket, and uninstalling the UI assembly.

* * * * *